US005100184A

United States Patent [19]

Schmitt

[11] Patent Number: 5,100,184

[45] Date of Patent: Mar. 31, 1992

[54] DEADLATCH ASSEMBLY

[76] Inventor: Thomas Schmitt, 7002 Auburn Ave., Wauwatosa, Wis. 53213

[21] Appl. No.: 658,067

[22] Filed: Feb. 20, 1991

[51] Int. Cl.[5] ..... E05C 1/06

[52] U.S. Cl. ..... 292/144; 292/153

[58] Field of Search ..... 292/144, 33, 34, 36, 292/37, 153, 74, 75, 216; 70/134

[56] References Cited

U.S. PATENT DOCUMENTS

| | | | |
|---|---|---|---|
| 2,117,715 | 5/1938 | Godfried | 292/74 X |
| 4,099,752 | 7/1978 | Geringer | 292/144 |
| 4,434,635 | 3/1984 | Borgato | 292/201 X |
| 4,739,638 | 4/1988 | Lin | 292/74 X |
| 4,865,367 | 9/1989 | Choi | 292/153 X |

OTHER PUBLICATIONS

Assa Says "Halt" Locksmith Ledger, vol. 45, No. 11, Oct. 1985, p. 17, 5 sheets.

"Heavy Duty Deadlatch Series" Adams Rite Mfg. Co., 4710 1977, BHMA Type E 8231 2 Sheets.

*Primary Examiner*—Richard E. Moore

*Attorney, Agent, or Firm*—Andrus, Sceales, Starke & Sawall

[57] ABSTRACT

A deadlatch assembly of the type that provides remote operation to control traffic during and after business hours in a building. The deadlatch assembly includes a solenoid actuator for moving the deadlatch cam to its unblocking position when the auxiliary bolt is retracted and the door closed. A ramp in the strike plate and a beveled latch bolt facilitates opening of the door without the need for an electric strike.

3 Claims, 2 Drawing Sheets

DEADLATCH ASSEMBLY

BACKGROUND OF THE INVENTION

The present invention relates to locks, and more particularly to a deadlatch assembly.

Various types of deadlatch assemblies are known in the art. Deadlatch assemblies are typically employed at hospitals, banks, stores and other buildings to provide security as well as flexibility of traffic control during and after business hours. Deadlatch assemblies are therefore designed to allow two-way traffic i.e. free entrance and exit at some times and exit-only traffic at other times. Such deadlazch assemblies are typically employed with narrow type door applications such as aluminum doors, which are commonly employed in the above-noted buildings.

As a means for increasing security, some deadlatch assemblies include remote operation which permits a door to be unlocked by an attendant who is at a remote location. In such applications, a solenoid operated strike is typically employed to release the door and allow entrance or exit. Thus, a remote attendant can electrically actuate a solenoid which in turn moves the strike plate from a position where it blocks the latch bolt to an unblocking position to permit free movement of the door.

SUMMARY OF THE INVENTION

The present invention provides a deadlatch assembly of rhe type that provides remote operation to control traffic during and after business hours in a building. The deadlarch assembly eliminates the need for an electric strike and thus substantially reduces the overal cost of such assemblies.

In order to accomplish this, the deadlatch assembly of the present invention comprises a casing including a pair of opposite spaced apart side walls interconnected by a front plate, a latch bolt slidably mounted in said casing and movable between a first locking position projecting from said front plate and a second retracted or unlocking position located between said side walls, first spring means for biasing said latch bolt to its first position, an auxiliary bolt slidably mounted in said casing and movable between a first position projecting from said front plate and a second position located between said side walls, second spring means for biasing said auxiliary bolt to its first position, cam means mounted in said casing and operatively connected to said auxiliary bolt for movement between a first deadlatch position blocking movement of said latch bolt from its locking position to its unlocking position when said auxiliary bolt is in its second position, and a second unblocking position permitting sliding movement of said latch bolt from its locking to its unlocking position when said auxiliary bolt is in its first position, and cam actuation means mounted on said casing for moving said cam means from its first deadlatch position to its second unblocking position when said auxiliary bolt is in its second position.

Preferably, the cam actuation means includes an electro-responsive driver such as a solenoid and an actuator arm operatively engaged with the cam means and movable by the driver to in turn move the cam means to its unblocking position. Once the latch bolt is unblocked or released the door may be readily opened be someone desiring to enter or exit a room or building. In order to facilitate movement of the latch bolt after the driver has been actuated, the assembly includes a beveled side face on the outer end of the latch bolt and a ramp means on the strike plate engageable with the beveled side face. The combination of these two features facilitates sliding movement of the latch bolt from its locking to its unlocking position when the door is pushed or pulled open.

The present invention thus provides a relatively inexpensive deadlatch assembly that functions not only to provide flexibility of traffic control but also to provide security via remote operation. The compactness of the assembly also facilitates installation by reducing labor costs as well as material costs.

BRIEF DESCRIPTION OF THE DRAWINGS

The drawings illustrate the best mode presently contemplated of carrying out the invention.

In the drawings.

DESCRIPTION OF THE PREFERRED EMBODIMENT

Figure 1:
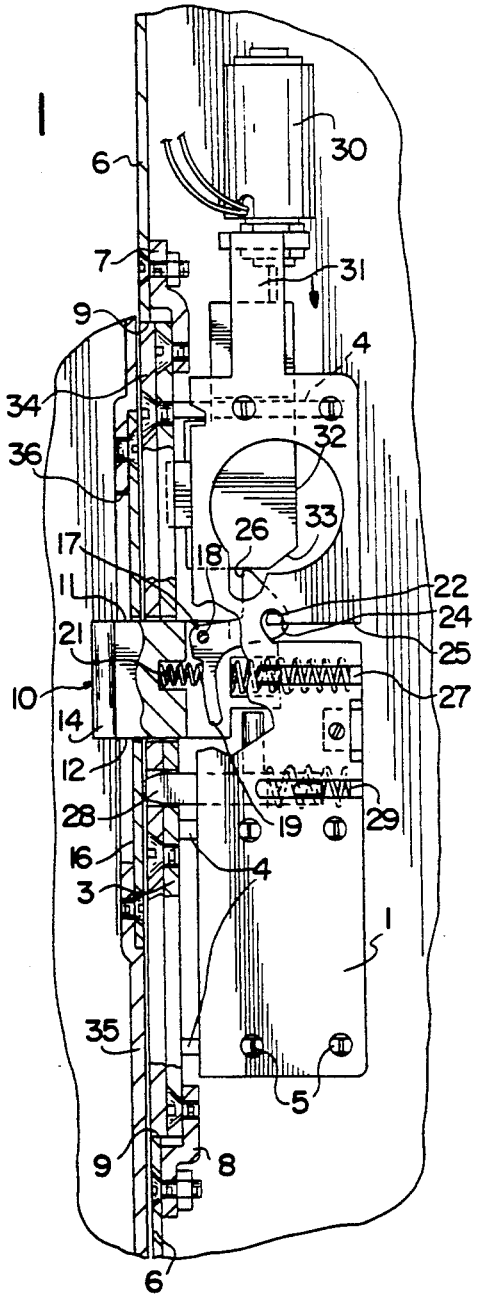
FIG. 1 is a fragmentary side view in elevation with parts broken away illustrating a deadlatch assembly moulded in the stile of a hollow door with the latch belt in its deadlocked position.

Referring now to the drawings, there is illustrated a deadlatch assembly constructed in accordance with the principles of the present invention. The deadlatch assembly is illustrated as being mounted in the stile of a hollow aluminum door. However, the present invention is not limited to such an environment and may be employed and adapted for use in connection with other door applications.

Referring now to FIGS. 1–3 and 5, the deadlatch assembly includes a casing or housing comprising a pair of opposite spaced apart planar side walls 1 and 2 interconnected along their front edges by a front plate 3 and by a plurality of braces 4 which extend between walls 1 and 2 and which lend rigidity to the casing or housing. The braces 4 are secured to side walls 1 and 2 by means of a peened connection as at 5. A face plate 34 having a finished outer surface is attached to front plate 3. The casing or housing is mounted in stile 6 of a door by means of brackets 7 and 8 which are mounted at opposite ends of an opening 9 formed in stile 6 for receiving the deadlatch assembly.

Figure 2:
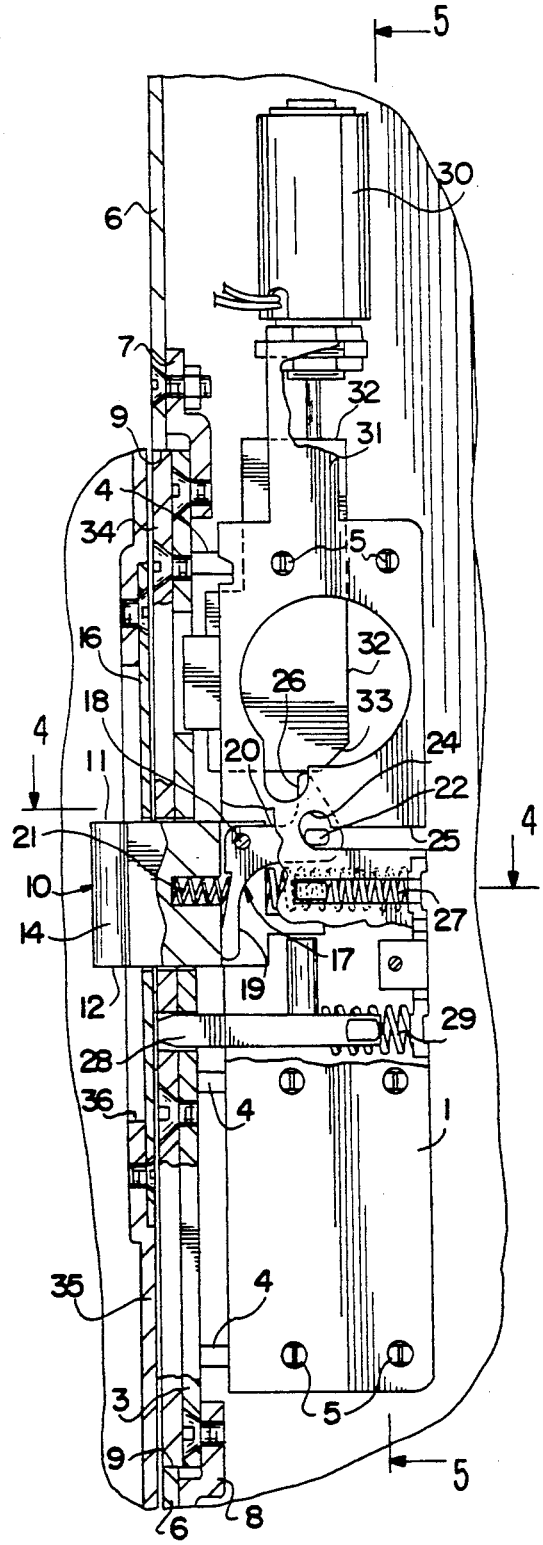
FIG. 2 is a fragmentary side view similar to FIG. 1 except illustrating the solenoid actuated and the cam member moved to its unblocking position permitting sliding movement of the latch bolt to its unlocked position.
Figure 3:
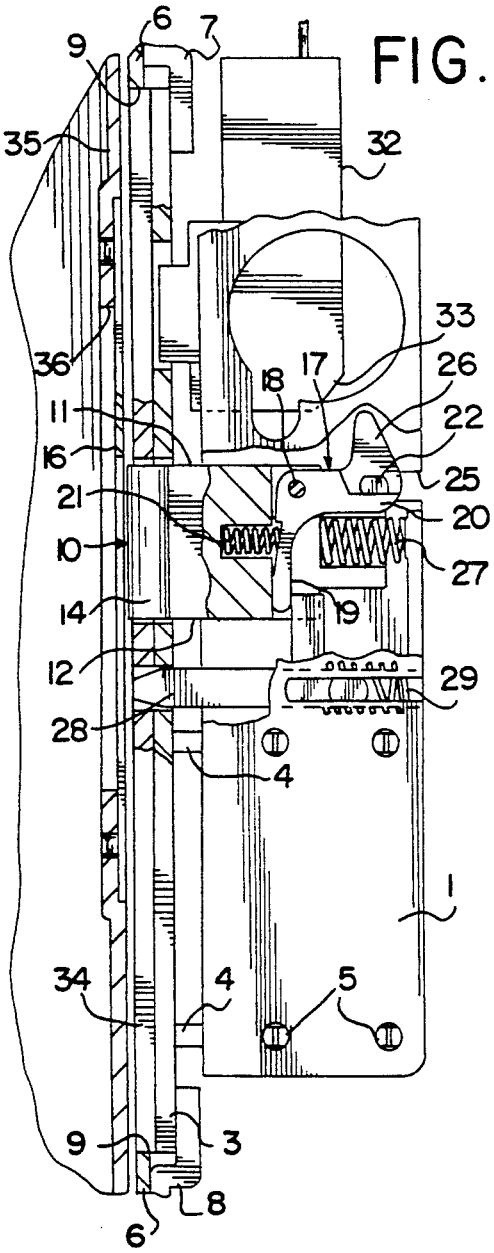
FIG. 3 is a fragmentary side view similar to FIGS. 1 and 2 except illustrating the latchbolt retracted as the door is about to be opened.
Figure 5:
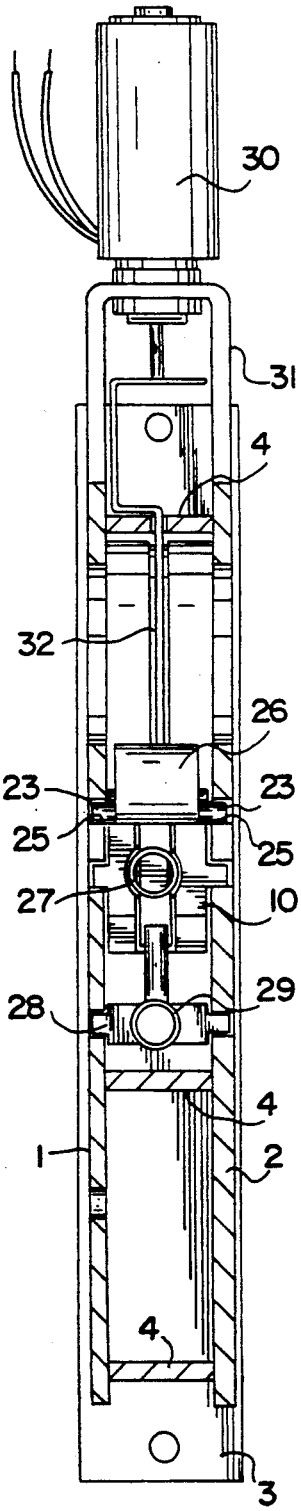
FIG. 5 is a cross sectional end view taken along the plane of the line 5—5 in FIG. 2.
Figure 4:
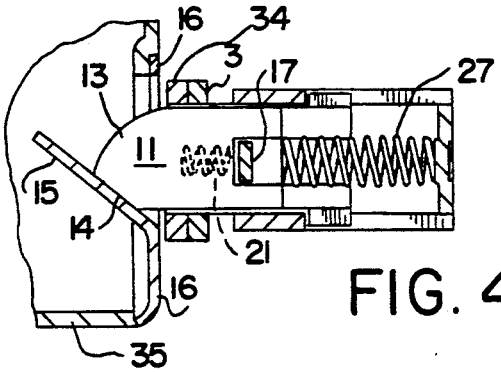
FIG. 4 is a cross sectional view taken along the plane of the lines 4—4 in FIG. 2.

A larch bolt 10 is slidably mounted in the casing for movement between a first locking position projecting from front plate 3 and a second unlocking or retracted position located between side walls 1 and as shown best in FIG. 3. Referring to FIGS. 2 and 4, latch bolt 10 includes a top face 11, a bottom face 12 and opposite side faces 13 and 14. Side face 13 is arcuate shaped while the opposite side face 14 is beveled at approximately a 45° angle, as shown best in FIG. 4. As also shown best in FIG. 4, the bevel on side face 14 is engageable with a ramp 15 formed as an integral portion of strike plate 16. As is conventional, strike plate 16 is mounted in a door jamb 35 of a doorway. Strike plate 16 includes a cutout 36 for receiving the outer end of latch bolt 10. As will be described later herein, beveled side face 14 and ramp 15 facilitate the opening of the door by facilitating sliding movement of latch bolt 10.

A cam member 17 is pivotally mounted by a pin 18 on one inner end of latch bolt 10. Cam member 17 includes a first leg 19 projecting downwardly from pin 18 and a second leg 20 projecting rearwardly from pin 18. Cam member 17 is movable between a first deadlatched position (FIG. 1) blocking movement of latch bolt 10 from its locking position to its unlocking position and a second unblocking position (FIG. 2) permitting sliding movement of latch bolt 10 from its locking to its unlocking position. A spring 21 captured within a bore formed in the inner end of latch bolt 10 engages leg 19 and biases cam member 17 to its blocked position. In order to deadlatch or block latch bolt 10, cam member 17 includes a pair of opposite bosses 22 and 23 integrally projecting from leg 20 of cam 17. Bosses 22 and 23 are received within a pair of recesses 24 formed at the inner end of a channel 25 in each side wall 1 and 2. Thus, when cam member 17 is pivoted to its deadlatch or blocking position, it is located as shown in FIG. 1. In its unblocking position, cam member 17 is pivoted against the bias or force of spring 21 so that bosses 22 and 23 are no longer received within recesses 24, as shown in FIG. 2. Leg 20 also includes an upstanding finger 26 projecting upwardly from bosses 22 and 23, the purposes of which will hereinafter be described.

A spring 27 mounted on the casing between side walls 1 and 2 is employed to bias latch bolt 10 to the left as shown in FIGS. 1 and 2, i.e. its locking position projecting from front plate 3 into strike plate 16. An auxiliary bolt 28 is located below latch bolt 10 and is slidably mounted in the casing between a first position projecting from face plate 3 and a second or retracted position located between side walls 1 and 2, as shown in FIGS. 1 and 2. Auxiliary bolt 28 is of conventional design and includes a spring 29 for biasing bolt 28 to its first or projecting position. Auxiliary bolt 28 functions in its conventional manner and is operatively connected to cam member 17 to move cam member 17 to its blocked position when auxiliary bolt 28 is retracted (as shown in FIG. 1), and to permit cam member 17 to move to its unblocking position when projecting from front plate 3. It should be noted that in the conventional door application, auxiliary bolt 28 is retracted so that latch bolt 10 is deadlatched when the door is closed since strike plate 16 forces auxiliary bolt 28 into its retracted position.

As a means for actuating cam member 17 from its first deadlatched position (FIG. 1) to its second unblocking position (FIG. 2) when the auxiliary bolt 28 is in its second or retracted position, the deadlatch assembly of the present invention includes an electro-responsive driver in the form of a solenoid 30 mounted by means of a bracket 31 to the top of side walls 1 and 2 together with an actuator arm 32 movable by driver 30 to engage and move cam member 17 downwardly, as shown best in FIG. 2. Actuator arm 32 includes a C-shaped upper portion integrally connected with a longitudinally extended planar lower section (See FIG. 5). The upper section of arm 32 is engageable by solenoid 30 while the lower edge of arm 32 is engageable with the tip of finger 26 of cam member 17. Thus, upon movement of arm 32 downwardly, cam 17 is pivoted to its unblocking position as shown in FIG. 2. Thereafter, the door in which the present deadlatch assembly is mounted may be pulled or pushed open since latch bolt 10 is free to move to its retracted position by the engagement of beveled side face 14 with ramp 15 as the door is opened. Note that bosses 22 and 23 slide within channel 25 a shown best in FIG. 3, to permit movement of latch bolt 10 and the opening of the door.

In operation, and assuming the door in which the present deadlatch assembly is mounted is closed, the components of the deadlatch assembly are positioned substantially as shown in FIG. 1. Latch bolt 10 is deadlocked and cannot be slid to its unlocking position since auxiliary bolt 28 is retracted and bosses 22 and 23 are received within recesses 24 to prevent sliding movement to the right as shown in FIG. 1. If, however, solenoid 30 is actuated, arm 32 is pushed downwardly against finger 26 of cam 17 to move cam 17 to the position shown in FIG. 2 whereby bosses 22 and 23 are no longer received within recesses 24 of channels 25. Thereafter, when the door is pushed or pulled in order to open it the beveled side face 14 of latch bolt 10 engages ramp 15 of strike plate 16 forcing latch bolt 10 to the right or to its unlocking position as shown in FIG. 3. Once the person passes through the door and the door begins to close, the arcuate surface of side face 13 of latch bolt 10 permits retraction of latch bolt 10 against the force of spring 27 to permit the door to pass the edge of door jamb 35 and to thereafter reengage within strike plate 16. At the same time, auxiliary bolt 28 is moved to its retracted position to once again force bosses 22 and 23 into recesses 24 of side walls 1 and 2 to thereby once again deadlock latch bolt 10. The lower section of actuator arm 32 includes a rounded or beveled edge 33 to prevent possible catching of finger 26 on the lower edge of actuator arm 32 when latch bolt 10 is moved outwardly by the force of spring 27 to thus ensure proper operation of the assembly.

Various modes of carrying out the invention are contemplated as being within the scope of the following claims particularly pointing out and distinctly claiming the subject matter regarded as the invention.

I claim:

1. A deadlatch assembly comprising;

a casing including a pair of opposite spaced apart side walls interconnected by a front plate;

a latch bolt slidably mounted in said casing and movable between a first locking position projecting from said front plate and a second unlocking position located between said side walls, said latch bolt includes top, bottom and opposite side faces, and one of said side faces is beveled;

first spring means for biasing said latch bolt to its first position;

an auxiliary bolt slidably mounted in said casing and movable between a first position projecting from said front plate and a second position located between said side walls;

second spring means for biasing said auxiliary bolt to its first position;

cam means mounted in said casing and operatively connected to said auxiliary bolt for movement between a first deadlatch position blocking movement of said latch bolt from its locking position to its unlocking position when said auxiliary bolt is in its second position, and a second unblocking position permitting sliding movement of said latch bolt from its locking to its unlocking position when said auxiliary bolt is in its first position;

cam actuation means mounted on said casing for moving said cam means from its first deadlatch position to its second unblocking position when said auxiliary bolt is in its second position; and a strike plate mounted adjacent said front plate, said strike plate including a cutout for receiving said latch bolt therein and ramp means engageable with said beveled side face of said latch bolt to facilitate sliding movement of said latch bolt from its locking to its unlocking positions upon application of a door opening force transversely of the sliding direction of said latch bolt.

2. The deadlatch assembly of claim 1 wherein said cam actuation means includes an electro-responsive driver and an actuator arm operatively engageable with said cam means and movable by said driver to in turn move said cam means to its unlocking position.

3. The deadlatch assembly of claim 3 wherein said electro-responsive driver is a solenoid.

* * * * *